US006528471B1

(12) United States Patent
Del Duca et al.

(10) Patent No.: US 6,528,471 B1
(45) Date of Patent: Mar. 4, 2003

(54) PROCESS OF TREATING FABRICS WITH A LAUNDRY ADDITIVE

(75) Inventors: Valerio Del Duca, Massalubrense (IT); Andrea Esposito, Rome (IT); Milena Leone, Gallarate (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/889,050

(22) PCT Filed: Jan. 20, 2000

(86) PCT No.: PCT/US00/01385

§ 371 (c)(1), (2), (4) Date: Jul. 11, 2001

(87) PCT Pub. No.: WO00/43484

PCT Pub. Date: Jul. 27, 2000

(30) Foreign Application Priority Data

Jan. 22, 1999 (EP) ..... 99870010

(51) Int. Cl.[7] ..... C11D 3/395
(52) U.S. Cl. ..... 510/318; 510/309
(58) Field of Search ..... 510/276, 309, 510/318

(56) References Cited

U.S. PATENT DOCUMENTS

| | | | |
|---|---|---|---|
| 3,965,024 | A | 6/1976 | Schmadel et al. |
| 5,066,749 | A | 11/1991 | Leighton et al. |

FOREIGN PATENT DOCUMENTS

| | | | |
|---|---|---|---|
| EP | 844302 | A1 | 5/1996 |
| EP | 845526 | A2 | 6/1998 |
| WO | WO 98/22560 | | 5/1996 |

*Primary Examiner*—Yogendra N. Gupta
*Assistant Examiner*—John M Petruncio
(74) *Attorney, Agent, or Firm*—James F. McBride; Frank C. Turner; Kim W. Zerby

(57) ABSTRACT

A process of treating fabrics comprises the steps of forming an aqueous bath comprising water, dissolving or dispersing a conventional laundry detergent therein, adding a liquid composition comprising a peroxygen bleach, a builder and a modified polycarboxylate co-builder and subsequently contacting said fabrics with said aqueous bath. Furthermore, the use of a builder and a modified polycarboxylate co-builder in a laundry additive comprising a peroxygen bleach to treat fabrics, whereby stain removal and/or bleaching benefits are provided, is also claimed.

14 Claims, No Drawings

PROCESS OF TREATING FABRICS WITH A LAUNDRY ADDITIVE

CROSS REFERENCE TO RELATED APPLICATIONS

This reference claims the benefit of PCT Application Serial No. PCT/US00/01385, filed Jan. 20, 2000, which in turn claims priorty to EP 99870010.8, filed Jan. 22, 1999.

TECHNICAL FIELD

The present invention relates to a process of treating fabrics with liquid peroxygen bleach-containing compositions. Said compositions are suitable for use as laundry additive in addition to a conventional detergent. More particularly, the compositions herein are suitable for use on various fabrics to provide stain removal and/or bleaching performance.

BACKGROUND

Bleach-containing compositions for bleaching fabrics, are well known in the art.

Liquid peroxygen bleach-containing compositions have been extensively described in the art, especially in laundry applications as laundry detergents, laundry additives or laundry pretreaters.

Indeed, it is known to use such peroxygen bleach-containing compositions as laundry additives to boost the removal of encrusted stains/soils and "problem" stains, such as grease, coffee, tea, grass, mud/clay-containing soils, which are otherwise particularly difficult to remove by typical machine washing.

However, there are some limitations to the convenience of said peroxygen bleach-containing compositions used as laundry additives. In particular, it is well known from consumer research that the stain removal performance of said compositions may still be further improved.

It is thus an objective of the present invention to provide a process of treating fabrics with a laundry additive providing an overall improved stain removal performance on a wide range of stains whilst also delivering excellent bleaching performance.

It has now been found that this objective can be met by a process of treating fabrics with a laundry additive being a liquid composition comprising a peroxygen bleach, a builder and a co-builder as described herein.

Indeed, such compositions boost the stain removal performance of various types of stains including greasy stains and/or enzymatic stains when used as a laundry additive as compared to the stain removal performance delivered by the same compositions comprising a different or no builder system.

Advantageously, the compositions as described herein also provide excellent bleaching performance.

A further advantage of the compositions according to the present invention is that they are able to perform in a variety of conditions, i.e., in hard and soft water as well as when used neat or diluted.

Yet another advantage of the, compositions of the present invention is that said compositions are suitable for bleaching any type of fabrics including natural fabrics (e.g., fabrics made of cotton, viscose, linen, silk and wool), synthetic fabrics such as those made of polymeric fibers of synthetic origin as well as those made of both natural and synthetic fibers.

BACKGROUND ART

EP-A-0 686 691 and EP-A-0 844 302 disclose compositions comprising a peroxygen bleach and a citrate or citric acid suitable for use as laundry additives or fabric pretreaters. None of the cited documents discloses a process of bleaching fabrics with a composition comprising a peroxygen bleach, a builder and a modified polycarboxylate co-builder.

SUMMARY OF THE INVENTION

The present invention encompasses a process of treating fabrics which comprises the steps of forming an aqueous bath comprising water, a conventional laundry detergent dissolved or dispersed therein and a liquid composition comprising a peroxygen bleach, a builder and a modified polycarboxylate co-builder and subsequently contacting said fabrics with said aqueous bath.

The present invention further encompasses the use of a builder and a modified polycarboxylate co-builder in a laundry additive comprising a peroxygen bleach to treat fabrics, whereby stain removal and/or bleaching benefits are provided.

DETAILED DESCRIPTION OF THE INVENTION

Process of Treating Fabrics

The process of treating fabrics according to the present invention, comprises the steps of forming an aqueous bath comprising water, a conventional laundry detergent dissolved or dispersed therein and a liquid composition comprising a peroxygen bleach, a builder and a modified polycarboxylate co-builder and subsequently contacting said fabrics with said aqueous bath.

In such a process the fabrics to be treated are contacted with a liquid composition, as defined herein. This is done in a "through the wash mode", where a liquid composition, as defined herein, is used in addition to a wash liquor formed by dissolution or dispersion of a conventional laundry detergent in water, i.e., the liquid composition is used as a so-called "laundry additive". The dilution level of the liquid composition in an aqueous bath is typically up to 1:85, preferably up to 1:50 and more preferably 1:25 (composition:water). The fabrics are then contacted with the aqueous bath comprising the liquid composition and the conventional laundry detergent. Preferably, the fabrics are finally rinsed.

In a preferred embodiment, the liquid composition is added to the aqueous bath in its neat form.

By "conventional laundry detergent" it is meant herein, a laundry detergent composition currently available on the market. Said laundry detergent compositions may be formulated as powders or as liquids. Suitable laundry detergent compositions are for example DASH futur®, DASH liquid® and products sold under the trade names ARIEL® or TIDE®.

In a preferred embodiment, the conventional laundry detergent as described herein comprises at least one surface active agent.

The contacting of the fabrics with the aqueous bath as described herein may be achieved by means of a washing machine or simply by hand.

By "treating" it is meant herein, cleaning, as the composition according to the present invention provides excellent stain removal performance on a broad range of stains and soils and on various surfaces due mainly to the presence of a builder and a co-builder as defined herein, as well as bleaching, as the composition according to the present invention provides excellent bleach performance due mainly to the presence of the peroxygen bleach.

By "in its neat form", it is to be understood that the liquid compositions are added to the aqueous bath herein without undergoing any dilution, i.e., the liquid compositions herein are added as described herein.

The Liquid Composition

The compositions according to the present invention are liquid compositions as opposed to a solid or a gas. As used herein "liquid" includes compositions in gel and paste form.

Accordingly, preferred compositions of the present invention have a viscosity of 1 cps or greater, more preferably of from 10 to 5000 cps, and still more preferably of from 10 to 2500 cps at 20° C. when measured with a $CSL^2$ 100® Rheometer at 20° C. with a 4 cm spindle (linear increment from 10 to 100 dyne/$cm^2$ in 2 minutes).

The liquid compositions according to the present invention preferably have a pH of up to 9, more preferably from 2 to 7, and most preferably from 2 to 6. In a preferred embodiment the compositions according to the present invention are formulated in the neutral to the acidic pH range, which contributes to the chemical stability of the compositions and to the stain removal performance of the compositions. The pH of the compositions may be adjusted by an acidifying agent known to those skilled in the art or a mixture thereof. Examples of acidifying agents are inorganic acids such as sulphuric acid.

Peroxygen Bleach

As a first essential ingredient the compositions according to the present invention comprise a peroxygen bleach or a mixture thereof. Indeed, the presence of a peroxygen bleach contributes to the excellent bleaching benefits of said compositions.

Suitable peroxygen bleaches to be used herein are selected from the group consisting of: hydrogen peroxide; water soluble sources of hydrogen peroxide; organic or inorganic peracids; hydroperoxides; diacyl peroxides; and mixtures thereof.

As used herein a hydrogen peroxide source refers to any compound that produces perhydroxyl ions on contact with water. Suitable water-soluble sources of hydrogen peroxide for use herein include percarbonates, perborates, persilicates and mixtures thereof.

Suitable diacyl peroxides for use herein include aliphatic, aromatic and aliphatic-aromatic diacyl peroxides, and mixtures thereof.

Suitable aliphatic diacyl peroxides for use herein are dilauroyl peroxide, didecanoyl peroxide, dimyristoyl peroxide, or mixtures thereof. A suitable aromatic diacyl peroxide for use herein is for example benzoyl peroxide. A suitable aliphatic-aromatic diacyl peroxide for use herein is for example lauroyl benzoyl peroxide. Such diacyl peroxides have the advantage of being particularly safe to fabrics and color while delivering excellent bleaching performance when used in any laundry application.

Suitable organic or inorganic peracids for use herein include: persulphates such as monopersulfate; peroxyacids such as diperoxydodecandioic acid (DPDA); magnesium perphthalic acid; perlauric acid; phthaloyl amidoperoxy caproic acid (PAP); perbenzoic and alkylperbenzoic acids; and mixtures thereof.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage to be particularly safe to fabrics and color while delivering excellent bleaching performance when used in any laundry application.

Preferred peroxygen bleaches herein are selected from the group consisting of: hydrogen peroxide; water soluble sources of hydrogen peroxide; organic or inorganic peracids; hydroperoxides; and diacyl peroxides; and mixtures thereof. More preferred peroxygen bleaches herein are selected from the group consisting of hydrogen peroxide and diacyl peroxides and mixtures thereof. Even more preferred peroxygen bleaches herein are selected from the group consisting of hydrogen peroxide, aliphatic diacyl peroxides, aromatic diacyl peroxides and aliphatic-aromatic diacyl peroxides and mixtures thereof.

Typically, the compositions herein may comprise from 0.01% to 20%, preferably from 0.3% to 15% and more preferably from 0.5% to 10% by weight of the total composition of said peroxygen bleach or a mixture thereof.

Builder

As a second essential ingredient the compositions herein comprise one or more builders.

Suitable builders are selected from the group consisting of organic acids and salts thereof; polycarboxylates; and mixtures thereof. Typically said builders have a calcium chelating constant (pKCa) of at least 3. Herein the pKCa the value of a builder or a mixture thereof is measured using an 0.1M $NH_4Cl$—$NH_4OH$ buffer (pH 10 at 25° C.) and a 0.1% solution of said builder or mixture thereof with a standard calcium ion electrode.

Examples of builders are organic acids like citric acid, lactic acid, tartaric acid, oxalic acid, malic acid, monosuccinic acid, disuccinic acid, oxydisuccinic acid, carboxymethyl oxysuccinic acid, diglycolic acid, carboxymethyl tartronate, ditartronate and other organic acid or mixtures thereof.

Suitable salts of organic acids include alkaline, preferably sodium or potassium, alkaline earth metal, ammonium or alkanolamine salts.

Such organic acids and the salts thereof are commercially available from Jungbunzlaur, Haarman & Reimen, Sigma-Aldrich or Fluka.

Other suitable builders include a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Useful polycarboxylates include homopolymers of acrylic acid and copolymers of acrylic acid and maleic acid.

Other useful polycarboxylate builders include the ether hydroxypolycarboxylates, copolymers of maleic anhydride with ethylene or vinyl methyl ether, 1,3,5-trihydroxy benzene-2,4,6-trisulfonic acid, and carboxymethyloxysuccinic acid, the various alkali metal, ammonium and substituted ammonium salts of polyacetic acids such as nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Suitable polycarboxylates are commercially available from Rohm & Haas under the trade name Norasol® or Acusol®.

Preferred builders herein are selected from the group consisting of: citric acid; tartaric acid; tartrate monosuccinate; tartrate disuccinate; lactic acid; oxalic acid; and malic acid; and mixtures thereof. Even more preferred builders herein are selected from the group consisting of: citric acid; tartaric acid; tartrate monosuccinate; tartrate disuccinate; and malic acid; and mixtures thereof. The most preferred builders herein are selected from the group consisting of: citric acid; tartaric acid; tartrate monosuccinate; and tartrate disuccinate; and mixtures thereof.

Typically the compositions herein may comprise up to 40%, preferably from 0.01% to 25%, more preferably from 0.1% to 15%, and most preferably from 0.5% to 10% by weight of the total composition of said builder.

Modified Polycarboxylate Co-builder

As a third essential ingredient the compositions herein comprise a modified polycarboxylate co-builder.

The term "polycarboxylate" refers to compounds having a plurality of carboxylate groups, preferably at least 3 carboxylates.

By "modified polycarboxylate" it is meant herein that at least at one end of the polycarboxylate compound, i.e., the polycarboxylate chain, said compound is modified by a functional group, e.g., a phosphono group.

Preferred modified polycarboxylate co-builders are polycarboxylates with phosphono end groups.

By "phosphono end group" it is meant herein a phosphono functional group according to the formula:

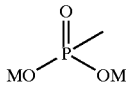

wherein each M is independently H or a cation, preferably both M are H.

Examples of suitable polycarboxylates with phosphono end groups are copolymers of acrylic acid and maleic acid having a phosphono end group and homopolymers of acrylic acid having a phosphono end group.

A preferred modified polycarboxylate is a copolymer of acrylic acid and maleic acid with a phosphonic/phosphono end group according to the general formula:

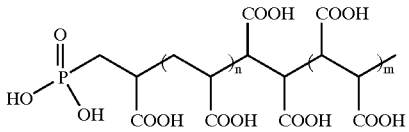

having an average molecular weight of from 1000 to 100000, preferably an average molecular weight of from 1000 to 20000, more preferably an average molecular weight of from 1000 to 10000, and most preferably an average molecular weight of from 1500 to 5000; wherein n is from 10 mol % to 90 mol %, preferably 80 mol % and m is from 10 mol % to 90 mol %, preferably 20 mol %.

Accordingly, an example of a suitable modified polycarboxylate is a copolymer of acrylic acid and maleic acid (80/20) with a phosphonic/phosphono end group according to the formula:

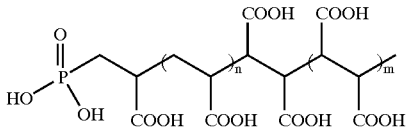

wherein n is 80 mol % and m is 20 mol %; having an average molecular weight of 2000.

Such modified polycarboxylate are available from Rohm & Haas under the trade name Acusol 425®, Acusol 420® or Acusol 470®.

Typically the compositions herein may comprise up to 40%, preferably from 0.01% to 25%, more preferably from 0.1% to 15%, and most preferably from 0.5% to 5% by weight of the total composition of said modified polycarboxylate co-builder.

A significant co-operation has been observed between a builder and a modified polycarboxylate co-builder in a peroxygen bleach-containing composition when used as a laundry additive. The co-operation results in improved stain removal performance on a variety of soils, from particulate to non-particulate soils from hydrophobic to hydrophilic soils on both hydrophilic and hydrophobic fabrics.

The present invention is based on the finding that compositions comprising a peroxygen bleach, a builder and a co-builder as described herein when used as a laundry additive, show an excellent stain removal performance on various types of stains including greasy stains (e.g., lipstick, olive oil, mayonnaise, vegetal oil, sebum, make-up) and enzymatic stains. The stain removal performance is improved, as compared to the stain removal performance delivered by the use of the same compositions as a laundry additive but without a builder system or comprising a different builder system.

Additionally, due to the presence of a peroxygen bleach, the bleaching compositions as described herein also provide excellent bleaching performance.

The stain removal performance may be evaluated by the following test methods on various types of stains.

A suitable test method for evaluating the stain removal performance on a soiled fabric under through the wash conditions is the following: A peroxygen bleach-containing composition according to the present invention is added neat into a standard washing machine in combination with a conventional laundry detergent (e.g., DASH futur® or DASH liquid®). A stained fabric (e.g., a fabric stained with a greasy stain or an enzymatic stain) is treated in said washing machine according to the standard procedure of the washing machine. After the treatment said fabric is compared to a similarly stained fabric treated as described above but with a peroxygen bleach-containing composition comprising no or another builder system as described herein.

A visual grading may be used to assign difference in panel units (psu) in a range from 0 to 4.

The bleaching performance may be evaluated as for the stain removal performance but the stains used are bleachable stains like coffee, tea and the like.

Optional Ingredients

The compositions herein may further comprise a variety of other optional ingredients such as chelating agents, surfactants, stabilisers, bleach activators, soil suspenders, soil suspending polyamine polymers, polymeric soil release agents, foam reducing systems, radical scavengers, catalysts, dye transfer agents, brighteners, perfumes, hydrotropes, solvents, pigments and dyes.

Surfactants

The compositions of the present invention may further comprise a surfactant or a mixture thereof including nonionic surfactants, zwitterionic surfactants, anionic surfactants, cationic surfactants and/or amphoteric surfactants.

In a preferred embodiment of the present invention the compositions according to the present invention comprise a nonionic surfactant or a zwitterionic betaine surfactant or a mixture thereof.

In another preferred embodiment of the present invention the compositions according to the present invention comprise a sulphonated anionic surfactant. More preferably said composition further comprises a second surfactant selected from the group consisting of nonionic surfactants, amphoteric surfactants, zwitterionic surfactants and mixtures thereof.

Typically, the compositions according to the present invention may comprise from 0.01% to 30%, preferably from 0.1% to 25% and more preferably from 0.5% to 20% by weight of the total composition of a surfactant.

Suitable nonionic surfactants include alkoxylated nonionic surfactants. Preferred alkoxylated nonionic surfactants herein are ethoxylated non ionic surfactants according to the formula RO—$(C_2H_4O)_nH$, wherein R is a $C_6$ to $C_{22}$ alkyl chain or a $C_6$ to $C_{28}$ alkyl benzene chain; and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of C9 and $C_{11}$ alkyl chains, n is 2.5), or Lutensol® TO3 (HLB=8; R is a $C_{13}$ alkyl chains, n is 3), or Lutensol® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture Of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7; R is a mixture of $C_9$ and $C_{11}$ alkyl chains, n is 8), Dobanol® 91-10 (HLB=14.2; R is a mixture of $C_9$ to $C_{11}$ alkyl chains, n is 10), Dobanol®) 91-12 (HLB=14.5; R is a mixture of $C_9$ to $C_{11}$ alkyl chains, n is 12), or mixtures thereof. Preferred herein are Dobanol® 91-2.5, or Lutensol® TO3, or Lutensol®) AO3, or Tergitol® 25L3, or Dobanol® 23-3, or Dobanol® 23-2, or Dobanol® 45-7, Dobanol® 91-8, or Dobanol® 91-10, or Dobanol®) 91-12, or mixtures thereof.

These Dobanol® surfactants are commercially available from SHELL. These Lutensol® surfactants are commercially available from BASF and these Tergitol® surfactants are commercially available from UNION CARBIDE.

Suitable chemical processes for preparing the alkoxylated nonionic surfactants for use herein include condensation of corresponding alcohols with alkylene oxide, in the desired proportions. Such processes are well known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Other suitable nonionic surfactants to be used herein include polyhydroxy fatty acid amide surfactants, or mixtures thereof, according to the formula:

$$R^2—C(O)—N(R^1)—Z,$$

wherein $R^1$ is H, or $C_1$-$C_4$ alkyl, $C_1$-$C_4$ hydrocarbyl, 2-hydroxy ethyl, 2-hydroxy propyl or a mixture thereof, $R^2$ is $C_5$-$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$-$C_4$ alkyl, more preferably $C_1$ or $C_2$ alkyl and most preferably methyl, $R^2$ is a straight chain $C_7$-$C_{19}$ alkyl or alkenyl, preferably a straight chain $C_9$-$C_{18}$ alkyl or alkenyl, more preferably a straight chain $C_{11}$-$C_{18}$ alkyl or alkenyl, and most preferably a straight chain $C_{11}$-$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2$—(CHOR')(CHOH)—$CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2$—$(CHOH)_4$—$CH_2OH$.

In formula $R^2$—C(O)—N($R^1$)—Z, $R^1$ can be, for example, N-methyl, N-ethyl, N-propyl, N-isopropyl, N-butyl, N-2-hydroxy ethyl, or N-2-hydroxy propyl. $R^2$—C(O)—N< can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulphonates, although other groups like sulfates, phosphonates, and the like can be used. A generic formula for the zwitterionic betaine surfactant to be used herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulphonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—NH—$(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is $C_1$–$C_4$ sulphonate group, or a $C_1$–$C_3$ alkyl and more preferably methyl. Preferred $R_4$ is $(CH_2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

A further example of betaine is Lauryl-iminodipropionate commercially available from Rhone-Poulenc under the trade name Mirataine $H_2C$-HA®.

Suitable anionic surfactants to be used in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below 50° C.) and $C_{16-18}$ alkyl chains are preferred for higher wash temperatures (e.g., above 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate ($C_{12}$–$C_{18}$E(1.0)SM), $C_{12}$–$C_{18}$ alkyl polyethoxylate (2.25) sulfate ($C_{12}$–$C_{18}$E(2.25)SM), $C_{12}$–$C_{18}$ alkyl polyethoxylate (3.0) sulfate ($C_{12}$–$C_{18}$E(3.0)SM), and $C_{12}$–$C_{18}$ alkyl polyethoxylate (4.0) sulfate ($C_{12}$–$C_{18}$E(4.0)SM), wherein M is conveniently selected from sodium and potassium.

Other suitable anionic surfactants for use herein are sulphonated anionic surfactants Suitable sulphonated anionic surfactants for use herein include alkyl sulphonates, alkyl aryl sulphonates, naphthalene sulphonates, alkyl alkoxylated sulphonates, $C_6$–$C_{20}$ alkyl alkoxylated linear or branched diphenyl oxide disulphonates, or mixtures thereof.

Suitable alkyl sulphonates for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{14}$–$C_{17}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl aryl sulphonates for use herein include water-soluble salts or acids of the formula $RSO_3M$ wherein R is an aryl, preferably a benzyl, substituted by a $C_6$–$C_{20}$ linear or branched saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Particularly suitable linear alkyl sulphonates include $C_{14}$–$C_{17}$ paraffin sulphonate like Hostapur® SAS commercially available from Hoechst. An example of commercially available alkyl aryl sulphonate is Lauryl aryl sulphonate from Su.Ma. Particularly preferred alkyl aryl sulphonates are alkyl benzene sulphonates commercially available under trade name Nansa® available from Albright&Wilson.

By "linear alkyl sulphonate" it is meant herein a non-substituted alkyl sulphonate wherein the alkyl chain comprises from 6 to 20 carbon atoms, preferably from 8 to 18 carbon atoms, and more preferably from 14 to 17 carbon atoms, and wherein this alkyl chain is sulphonated at one terminus.

Suitable alkoxylated sulphonate surfactants for use herein are according to the formula $R(A)_mSO_3M$ wherein R is an unsubstituted $C_6$–$C_{20}$ alkyl, hydroxyalkyl or alkyl aryl group, having a linear or branched $C_6$–$C_{20}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy or butoxy unit, m is greater than zero, typically between 0.5 and 6, more preferably between 0.5 and 3, and M is H or a cation which can be, for example, a metal cation (e.g., sodium, potassium, lithium, calcium, magnesium, etc.), ammonium or substituted-ammonium cation. Alkyl ethoxylated sulphonates, alkyl butoxylated sulphonates as well as alkyl propoxylated sulphonates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulphonate ($C_{12}$–$C_{18}E(1.0)$ $SO_3M$), $C_{12}$–$C_{18}$ alkyl polyethoxylate (2.25) sulphonate ($C_{12}$–$C_{18}E(2.25)$ $SO_3M$), $C_{12}$–$C_{18}$ alkyl polyethoxylate (3.0) sulphonate ($C_{12}$–$C_{18}E(3.0)$ $SO_3M$), and $C_{12}$–$C_{18}$ alkyl polyethoxylate (4.0) sulphonate ($C_{12}$–$C_{18}E(4.0)$ $SO_3M$), wherein M is conveniently selected from sodium and potassium. Particularly suitable alkoxylated sulphonates include alkyl aryl polyether sulphonate like Triton X-200® commercially available from Union Carbide.

Suitable $C_6$–$C_{20}$ alkyl alkoxylated linear or branched diphenyl oxide disulphonate surfactants for use herein are according to the following formula:

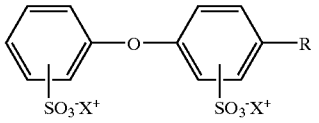

wherein R is a $C_6$–$C_{20}$ linear or branched, saturated or unsaturated alkyl group, preferably a $C_{12}$–$C_{18}$ alkyl group and more preferably a $C_{14}$–$C_{16}$ alkyl group, and X+ is H or a cation, e.g., an alkali metal cation (e.g., sodium, potassium, lithium, calcium, magnesium and the like). Particularly suitable $C_6$–$C_{20}$ alkyl alkoxylated linear or branched diphenyl oxide disulphonate surfactants to be used herein are the $C_{12}$ branched di phenyl oxide disulphonic acid and $C_{16}$ linear di phenyl oxide disulphonate sodium salt respectively commercially available by DOW under the trade name Dowfax 2A1® and Dowfax 8390®.

Other anionic surfactants useful for detersive purposes can also be used herein. These can include salts (including, for example, sodium, potassium, ammonium, and substituted ammonium salts such as mono-, di- and triethanolamine salts) of soap, sulphonated polycarboxylic acids prepared by sulphonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulphonates such as $C_{14-16}$ methyl ester sulphonates; acyl glycerol sulphonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_k$ $CH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants to be used herein also include acyl sarcosinate or mixtures thereof, in its acid and/or salt form, preferably long chain acyl sarcosinates having the following formula:

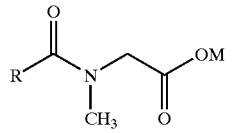

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants to be used herein include amine oxides having the following formula $R_1R_2R_3NO$ wherein each of $R_1$, $R_2$ and $R_3$ is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein $R_1$ is an hydrocarbon chain comprising from 1 to 30 carbon atoms, preferably from 6 to 20, more preferably from 8 to 16, most preferably from 8 to 12, and wherein $R_2$ and $R_3$ are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend $C_8$–$C_{10}$ amine oxides as well as $C_{12}$–$C_{16}$ amine oxides commercially available from Hoechst.

Chelating Agents

The compositions of the present invention may comprise a chelating agent as a preferred optional ingredient. Suitable chelating agents may be any of those known to those skilled in the art, such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it allows to increase the ionic strength of the compositions herein and thus their stain removal and bleaching performance on various surfaces. The presence of chelating agents may also contribute to reduce the tensile strength loss of fabrics and/or color damage, especially in a laundry through the wash application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents to be used-herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate .(DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes. ammonium salts thereof or mixtures thereof. Ethylenediamine N,N'-disuccinic acids, especially the (S,S) isomer, have been extensively described in U.S. Pat. No. 4,704,233, Nov. 3, 1987, to Hartman and Perkins. Ethylenediamine N,N'-disuccinic acid is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotri-acetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form,. or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

Another chelating agent for use herein is of the formula:

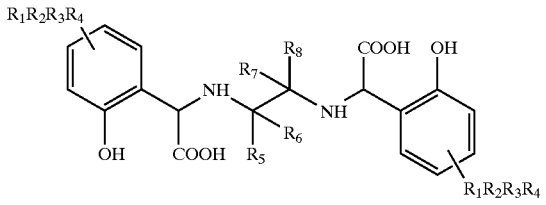

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents to be used herein are amino aminotri(methylene phosphonic acid), di-ethylene-triamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention may comprise up to 5%, preferably from 0.01% to 1.5% by weight and more preferably from 0.01% to 0.5% by weight of the total composition of a chelating agent.

Solvents

The compositions according to the present invention may further comprise a solvent or a mixture thereof.

Preferred solvents herein include hydrophobic solvents, hydrophilic solvents and mixtures hereof.

To define the hydrophilic or hydrophobic character of a solvent herein, the following hydrophilic index (HI) is used:

$$\frac{\text{molecular weight of the hydrophilic part of the solvent}}{\text{total molecular weight of the solvent}} * 100$$

By "hydrophilic part" of a given solvent it is meant herein all the groups O, CO, OH, of a given solvent.

By "molecular weight of the hydrophilic part of a solvent" it is meant herein the total molecular weight of all the hydrophilic parts of a given solvent.

The hydrophilic solvents to be used herein have a hydrophilic index of more than 18, preferably more than 25, and more preferably more than 30, and the hydrophobic solvents to the used herein have a hydrophilic index of less than 18, preferably less than 17 and more preferably 16 or less.

Suitable hydrophobic solvents to be used herein include paraffins, terpenes or terpene derivatives, as well as alkoxylated aliphatic or aromatic alcohols, aliphatic or aromatic alcohols, glycols or alkoxylated glycols, and mixtures thereof, all these solvents have a hydrophilic index of less than 18.

Suitable terpenes (hydrophilic index of 0) are mono-and bicyclic monoterpenes, especially those of the hydrocarbon class, which include the terpinenes, terpinolenes, limonenes and pinenes and mixtures thereof. Highly preferred materials of this type are d-limonene, dipentene, alpha-pinene and/or beta-pinene. For example, pinene is commercially available form SCM Glidco (Jacksonville) under the name Alpha Pinene P&F®.

Terpene derivatives such as alcohols, aldehydes, esters, and ketones which have a hydrophilic index of less than 18 can also be used herein. Such materials are commercially available as, for example, the α and β isomers of terpineol and linalool.

All type of paraffins (hydrophilic index of 0) can be used herein, both linear and branched, containing from 2 to 20, preferably from 4 to 10, more preferably from 6 to 8 carbon atoms. Preferred herein is octane. Octane is commercially available for example from BASF.

Suitable hydrophobic alkoxylated aliphatic or aromatic alcohols to be used herein are according to the formula R—$(A)_n$—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms, wherein A is an alkoxy group preferably an butoxy, propoxy and/or ethoxy group, and n is an integer of from 1 to 5, preferably 1 to 2. Suitable hydrophobic alkoxylated alcohol to be used herein is 1-methoxy-11-dodecanol (HI=15).

Suitable hydrophobic aliphatic or aromatic alcohols to be used herein are according to the formula R—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms. Suitable aliphatic alcohols to be used herein include linear alcohols like decanol (HI=7). Suitable aromatic alcohol to be used herein is benzyl alcohol (HI=16).

Suitable hydrophobic glycols to be used herein are according to the formula HO—$CR_1R_2$—OH wherein $R_1$ and $R_2$ are independently H or a $C_2$–$C_{10}$ saturated or unsaturated aliphatic hydrocarbon chain and/or cyclic hydrocarbon chain. Suitable glycol to be used herein is dodecaneglycol (HI=16).

Suitable hydrophobic alkoxylated glycols to be used herein are according to the formula R—$(A)_n$—$R_1$—OH wherein R is H, OH, a linear saturated or unsaturated alkyl of from 1 to 20, preferably from 2 to 15 and more preferably from 2 to 10 carbon atoms, wherein $R_1$ is H or a linear saturated or unsaturated alkyl of from 1 to 20, preferably from 2 to 15 and more preferably from 2 to 10 carbon atoms, and A is an alkoxy group preferably an ethoxy, methoxy, and/or propoxy group and n is from 1 to 5, preferably 1 to 2. Suitable alkoxylated glycol to be used herein is methoxy octadecanol (HI=11).

Particularly preferred hydrophobic solvents to be used herein include d-limonene, dipentene, alpha-pinene, beta-pinene, octane, benzyl alcohol, or mixtures thereof.

Suitable hydrophilic solvents to be used herein include alkoxylated aliphatic or aromatic alcohols, aliphatic or aromatic alcohols, glycols or alkoxylated glycols, and mixtures thereof, all these solvents having a hydrophilic index of more than 18.

Suitable hydrophilic alkoxylated aliphatic or aromatic alcohols to be used herein are according to the formula R—$(A)_n$—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms, wherein A is an alkoxy. group preferably a butoxy, propoxy and/or ethoxy group, and n is an integer of from 1 to 5, preferably 1 to 2. Particularly suitable alkoxylated alcohols to be used herein include methoxy propanol (HI=37), ethoxy propanol (HI=32), propoxy propanol (HI=28) and/or butoxy propanol (HI=27).

Suitable hydrophilic aliphatic or aromatic alcohols to be used herein are according to the formula R—OH wherein R is a linear or branched saturated or unsaturated alkyl group, or alkyl substituted or non-alkyl substituted aryl group of from 1 to 20, preferably from 2 to 15 and more preferably from 2 to 10 carbon atoms. Particularly suitable aliphatic alcohols to be used herein include linear alcohols like ethanol (HI=37) and/or propanol (HI=28).

Suitable hydrophilic glycols to be used herein are according to the formula HO—$CR_1R_2$—OH wherein $R_1$ and $R_2$ are independently H or a $C_2$–$C_{10}$ saturated or unsaturated aliphatic hydrocarbon chain and/or cyclic hydrocarbon chain. Particularly suitable glycol to be used herein is propanediol (HI=45).

Suitable hydrophilic alkoxylated glycols to be used herein are according to the formula R—$(A)_n$—$R_1$—OH wherein R is H, OH, a linear saturated or unsaturated alkyl group of from 1 to 20, preferably from 2 to 15 and more preferably from 2 to 10 carbon atoms, wherein $R_1$ is H or a linear saturated or unsaturated alkyl group of from 1 to 20, preferably from 2 to 15 and more preferably from 2 to 10 carbon atoms, and A is an alkoxy group preferably an ethoxy, methoxy, and/or propoxy group and n is from 1 to 5, preferably 1 to 2. Particularly suitable alkoxylated glycols to be used herein is ethoxyethoxyethanol (HI=37).

Typically, the compositions according to the present invention may comprise up to 30%, preferably from 0.01% to 15%, more preferably from 0.1% to 10%, and most preferably from 0.5% to 5% by weight of the total composition of a solvent.

In a preferred embodiment wherein the compositions herein comprise a mixture of a hydrophobic solvent and a hydrophilic solvent the weight ratio of said hydrophobic solvent to said hydrophilic is from 1:20 to 1:1, more preferably from 1:14to 1:2.

Solvents, when present, contribute to the excellent stain removal performance of the compositions used in a process as described herein.

Foam Reducing System

The compositions according to the present invention may further comprise a foam reducing agent or a mixture thereof. Any foam reducing agents known to those skilled in the art are suitable for use herein. In a preferred embodiment a foam reducing system comprising a fatty acid together with a capped alkoxylated nonionic surfactant as defined herein after and/or silicone is used.

Typically, the compositions herein may comprise from $1\cdot10^{-4}$% to 10%, preferably from $1\cdot10^{-3}$% to 5% and more preferably from $1\cdot10^{-2}$% to 5% by weight of the total composition of a fatty acid.

Typically, the compositions. herein may comprise from $1\cdot10^{-3}$% to 20%, preferably from $1\cdot10^{-2}$% to 10% and more preferably from $5\cdot10^{-2}$% to 5% by weight of the total composition of a capped alkoxylated nonionic surfactant as defined herein.

Typically, the compositions herein may comprise from $1\cdot10^{-5}$% to 5%, preferably from $1\cdot10^{-5}$% to 1% and more preferably from $1\cdot10^{"4}$% to 0.5% by weight of the total composition of a silicone.

Suitable fatty acids for use herein are the alkali salts of a $C_8$–$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22, preferably from 8 to 20 and more preferably from 8 to 18 carbon atoms.

Suitable fatty acids may be selected from caprylic acid, capric acid, lauric acid, myristic acid, palmitic acid, stearic acid, and mixtures of fatty acids suitably hardened, derived from natural sources such as plant or animal esters (e.g., palm oil, coconut oil, soybean oil, castor oil, tallow, ground oil, whale and fish oils and/or babassu oil.

For example Coconut Fatty Acid is commercially available from UNICHEMA under the name PRIFAC 5900®.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_{18}$ alkyl or alkenyl group, more preferably a $C_{10}$–$C_{15}$ alkyl or alkenyl group, even more preferably a $C_{10}$–$C_{15}$ alkyl group;

wherein $R_2$ is a $C_1$–$C_{10}$ linear or branched alkyl group, preferably a $C_2$–$C_{10}$ linear or branched alkyl group, preferably a $C_3$ group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier. Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units and hydrocarbyl groups of various types. Indeed, silicone compounds have been extensively described in the art, see for instance U.S. Pat. Nos. 4,076,648, 4,021,365, 4,749,740, 4,983,316, EP 150 872, EP 217 501 and EP 499 364. The silicone compounds disclosed therein are suitable in the context of the present invention. Generally, the silicone compounds can be described as siloxanes having the general structure:

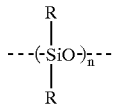

wherein n is from 20 to 2000, and where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from $5\times10^{-5}$ $m^2/s$ to 0.1 $m^2/s$, i.e., a value of n in the range 40 to 1500. These are preferred because of their ready availability and their relatively low cost.

A preferred type of silicone compounds useful in the compositions herein comprises a mixture of an alkylated siloxane of the type herein above disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}$ $m^2/s$ to 1 $m^2/s$. Preferred silicone compounds may have a viscosity in the range of from $5\times10^{-3}$ $m^2/s$ to 0.1 $m^2/s$. Particularly suitable are silicone compounds with a viscosity of $2\times10^{-2}$ $m^2/s$ or $4.5\times10^{-2}$ $m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2-3597® both commercially available from Dow Corning.

Another silicone compound is disclosed in Bartollota et al. U.S. Pat. No. 3,933,672. Other particularly useful silicone compounds are the self-emulsifying silicone compounds, described in German Patent Application DTOS 2 646 126 published Apr. 28, 1977. An example of such a compound is DC-544®, commercially available from Dow Corning, which is a siloxane-glycol copolymer.

Typically preferred silicone compounds are described in European Patent application EP-A-573699. Said compositions can comprise a silicone/silica mixture in combination with fumed nonporous silica such as Aerosil®.

Radical Scavenger

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®.

Radical scavengers when used, are typically present herein in amounts ranging from up to 10% and preferably from 0.001% to 0.5% by weight of the total composition.

The presence of radical scavengers may contribute to reduce tensile strength loss of fabrics and/or color damage when the compositions of the present invention are used in laundry through the wash application.

Antioxidant

The compositions according to the present invention may further comprise an antioxidant or mixtures thereof.

Typically, the compositions herein may comprise up to 10%, preferably from 0.002% to 5%, more preferably from 0.005% to 2%, and most preferably from 0.01% to 1% by weight of the total composition of an antioxidant.

Suitable antioxidants to be used herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activator

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

The compositions according to the present invention may comprise from 0.01% to 20%, preferably from 1% to 10%, and more preferably from 3% to 7% by weight of the total composition of said bleach activator.

The invention is further illustrated by the following examples.

EXAMPLES

Following compositions were made by mixing the listed ingredients in the listed proportions (weight % unless otherwise specified).

| Compositions | I | II | III | IV | V | VI | VII | VIII |
|---|---|---|---|---|---|---|---|---|
| Dobanol ® 23-3 | 1.0 | 2.0 | 1.0 | 2.0 | 2.0 | 1.0 | 2.0 | 1.0 |
| Dobanol ® 45-7 | 3.0 | 1.5 | 3.0 | 1.5 | — | 3.0 | 1.5 | 3.0 |
| Dobanol ® 91-8 | — | — | — | — | 1.0 | — | — | — |
| Dobanol ® 91-10 | — | — | — | — | 1.0 | — | — | — |
| Alkyl betaine | — | — | — | — | — | 2.5 | 2.5 | 2.0 |
| Hydrogen Peroxide | 7.0 | 7.0 | 8.0 | 9.0 | 7.0 | 7.0 | 8.0 | 6.0 |
| Citric acid | 2.0 | 1.0 | 2.0 | 2.0 | — | 1.0 | — | 2.0 |
| Norasol LMW-45N ® | 2.0 | 2.0 | 2.0 | 2.0 | 2.0 | 3.0 | 2.0 | 2.0 |
| Acusol 425 ® | 5.0 | 5.0 | 5.0 | 5.0 | 5.0 | 5.0 | 5.0 | 5.0 |
| Water and minors | up to 100% | | | | | | | |

| Compositions | IX | X | XI | XII | XIII | XIV | XV | XVI |
|---|---|---|---|---|---|---|---|---|
| Hydrogen Peroxide | 7.0 | 7.0 | 8.0 | 9.0 | 7.0 | 7.0 | 8.0 | 6.0 |
| Citric acid | 2.0 | 1.0 | 2.0 | 2.0 | — | 1.0 | — | 2.0 |
| Norasol LMW-45N ® | 2.0 | 2.0 | 2.0 | 2.0 | 2.0 | 3.0 | 2.0 | 2.0 |
| Acusol 425 ® | 5.0 | 5.0 | 5.0 | 5.0 | 5.0 | 5.0 | 5.0 | 5.0 |
| Water and minors | up to 100% | | | | | | | |

All examples have a pH of up to 9

Dobanol® 23-3 is a $C_{12}$–$C_{13}$ EO3 nonionic surfactant commercially available from SHELL.

Dobanol® 45-7 is a $C_{14}$–$C_{15}$ EO7 nonionic surfactant commercially available from SHELL.

Dobanol® 91-8 is a $C_9$–$C_{11}$ EO8 nonionic surfactant commercially available from SHELL.

Dobanol® 91-10 is a $C_9$-$C_{11}$ EO10 nonionic surfactant commercially available from SHELL.

Alkyl betaine is Lauryl di-methyl betaine commercially available by Hoechst under the trade name GENAGEN. LAB®.

Hydrogen Peroxide is commercially available from Ausimont.

Norasol LMW-45N® is a polycarboxylate builder commercially available from Rohm & Haas.

Acusol 425® is a modified polycarboxylate co-builder commercially available from Rohm & Haas.

The above mentioned compositions are employed in a process according to the present invention wherein fabrics, preferably stained fabrics, are treated according to said process by forming an aqueous bath comprising water, a conventional laundry detergent, preferably selected from the group consisting of DASH futur® and DASH liquid®, dissolved or dispersed therein and said liquid compositions.

All the above liquid compositions show bleaching and/or stain removal benefits when used in the process of the present invention to treat fabrics.

What is claimed is:

1. A process of treating fabrics which comprises the steps of forming an aqueous bath comprising water, a conventional laundry detergent dissolved or dispersed therein and a liquid composition comprising a peroxygen bleach, a builder and a modified polycarboxylate co-builder, wherein said co-builder is a polycarboxylate with a phosphono end group, and subsequently contacting said fabrics with said aqueous bath.

2. A process according to claim 1, wherein said builder is selected from the group consisting of: citric acid; tartaric acid; tartrate monosuccinate; tartrate disuccinate; lactic acid; oxalic acid; and malic acid; and mixtures thereof.

3. A process according to claim 1, wherein said composition comprises up to 40% by weight of the total composition of said builder.

4. A process according to claim 1, wherein said composition comprises up to 40% by weight of the total composition of said modified polycarboxylate co-builder.

5. A process according to claim 1, wherein said peroxygen bleach is selected from the group consisting of: hydrogen peroxide; water soluble sources of hydrogen peroxide; organic or inorganic peracids; hydroperoxides; and diacyl peroxides; and mixtures thereof.

6. A process according to claim 1, wherein said composition comprises from 0.01% to 20% by weight of the total composition of said peroxygen bleach.

7. A process according to claim 1, wherein said composition has a pH of up to 9.

8. A process according to claim 1, wherein said composition further comprises an acidifying agent or a mixture thereof.

9. A process according to claim 1, wherein said composition further comprises a first surfactant or a mixture thereof.

10. A process according to claim 9, wherein said first surfactant is a nonionic surfactant, zwitterionic betaine surfactant or a mixture thereof.

11. A process according to claim 9, wherein said first surfactant is a sulphonated anionic surfactant.

12. A process according to claim 11, wherein said composition further comprises a second surfactant selected from the group consisting of nonionic surfactants, amphoteric surfactants, zwitterionic surfactants and mixtures thereof.

13. A process according to claim 1, wherein said conventional laundry detergent comprises at least one surface active agent.

14. A process according to claim 1, wherein said composition further comprises a solvent or a mixture thereof.

* * * * *